US005236343A

United States Patent [19]

Pinto et al.

[11] Patent Number: 5,236,343

[45] Date of Patent: Aug. 17, 1993

[54] OPENING DEVICE

[75] Inventors: Akiva Pinto, Duesseldorf-Wittlaer; Guenter Lucassen, Haltern; Reinhard Schmidt, Gescher, all of Fed. Rep. of Germany

[73] Assignee: Hergeth Hollingsworth GmbH, Duelmen, Fed. Rep. of Germany

[21] Appl. No.: 852,162

[22] PCT Filed: Oct. 3, 1990

[86] PCT No.: PCT/EP90/01658

§ 371 Date: Apr. 3, 1992

§ 102(e) Date: Apr. 3, 1992

[87] PCT Pub. No.: WO91/05094

PCT Pub. Date: Apr. 18, 1991

[30] Foreign Application Priority Data

Oct. 5, 1989 [DE] Fed. Rep. of Germany ..... 3933272

[51] Int. Cl.[5] ..... B02C 19/12

[52] U.S. Cl. ..... 241/58; 241/101.7; 241/605; 19/80 R

[58] Field of Search ..... 241/101.7, 58, 57, 605; 19/80 R

[56] References Cited

U.S. PATENT DOCUMENTS

| | | | |
|---|---|---|---|
| 4,040,145 | 8/1977 | Marzoli | 19/81 |
| 4,595,149 | 6/1986 | Hergeth | 241/101 A |
| 4,771,513 | 9/1988 | Pinto et al. | 19/80 R |
| 4,854,507 | 8/1989 | Smith | 241/27 |
| 5,175,909 | 1/1993 | Pinto | 19/80 R |

FOREIGN PATENT DOCUMENTS 766953 1/1957 United Kingdom .

*Primary Examiner*—Mark Rosenbaum
*Assistant Examiner*—John M. Husar
*Attorney, Agent, or Firm*—Leatherwood Walker Todd & Mann

[57] ABSTRACT

In a device for opening pressed fiber bales and spinning material set up in rows along a bale supporting wall (12) by means of a milling device (5) accommodated in an arm casing (6) and having two parallel milling rollers (3,4) working on the surface (20) of the fiber bales (7). A suction hood is arranged above the milling rollers for sucking the loosened fibers off in an air flow. A suction opening (18), open towards the bale surface (20), is recessed between the milling rollers (3, 4) in the front wall (14) of the arm casing (6) facing the bale supporting wall (12) and a stripping device (26) abutting against the bale supporting wall (12), is arranged at the front wall (14) in the area of the suction opening (18).

8 Claims, 3 Drawing Sheets

FIG. 3
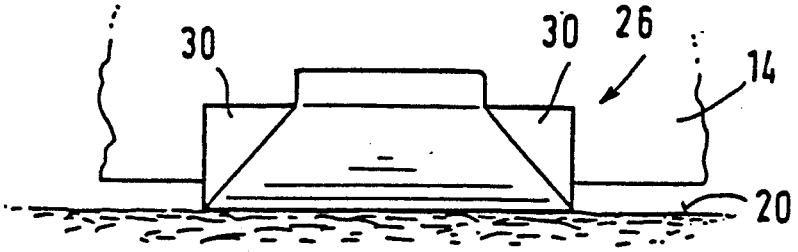
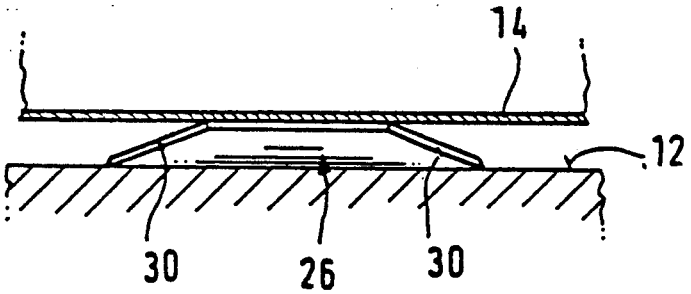
FIG. 4

OPENING DEVICE

BACKGROUND OF THE INVENTION

The invention relates to an opening device for a row of pressed fiber bales set up against a bale supporting wall.

Such opening devices are needed to reduce pressed fiber bales set up in rows and to convey loosened fiber flocks to the next processing machine in a flow of transport air. The pressed fiber bales may be set up along a bale supporting wall, the opening device, e.g. accommodated in the arm of a displaceable tower, moving along the wall, successively reducing the bales arranged before the same.

It is a problem of such milling devices that the toothed disc of the milling disc that is nearest the bale supporting wall does not get close enough to the wall to effect a complete reduction of the periphery of the bale so that an undesired narrow ridge will remain at the wall.

It is an object of the invention to improve an opening device such that it allows a total reduction of bale rows set up against a wall.

The object is solved by the features of the claims:

SUMMARY OF THE INVENTION

In the plane of the milling area, a suction opening in the front wall of the arm casing causes a strong suction flow between the arm casing and the bale supporting wall so that remainders of bales between the arm casing and the bale supporting wall are reliably sucked off without having to be loosened from the fiber material e.g. by a toothed roller.

It is provided that a stripping device abutting the bale support wall is arranged at the front end wall in the vicinity of the suction opening. The stripping device supports the sucking off of possible bale remainders at the bale support wall by peeling the bale remainders off the bale support wall using the stripping device, thereby facilitating their being sucked off via the suction opening.

Preferably, the cross section of the suction opening is enlargened towards the center between the milling rollers. Thus, the sucked-in flow is strongest in the center between the milling rollers.

The respective suction openings may begin in the plane of the milling area of the milling rollers so that the suction flow does not interfere with the milling process in the working area of the toothed rollers of the milling rollers on the bale surface.

In an embodiment of the present invention, it is contemplated that a suction opening is recessed in the rear wall of the arm casing opposite the front wall in the area between the milling rollers, the opening being open towards the bale surface. This suction opening allows to reduce the periphery of the pressed fiber bales, even when the set up rows of bales take the entire length of the arm.

An air-intake opening may be provided in the front wall of the arm casing, having an adjustable air-intake cross section. By means of this air-intake opening, the ratio of the quantity of air sucked in via the same may be adjusted relative to the quantity of air sucked in otherwise, thus allowing an adjustment of the air flow velocity at the suction openings in the front walls.

The front wall of the arm casing may first extend rectangularly to the milling roller axes in the region of the milling rollers and, finally, is angled in an acute angle relative to the bale supporting wall on both sides of the milling area.

The front wall being laterally recessed on both sides of the milling area, the supply of air to the suction opening in the front wall is facilitated in the wall milling process. Moreover, the inclined front wall areas allow the arm to get closer to the bale supporting wall, since the free space needed to prevent collisions when turning the tower can be reduced.

BRIEF DESCRIPTION OF THE DRAWINGS

The following is detailed description of an embodiment of the present invention with reference to the drawings.

In the Figures:

FIG. 3 is a front view of an embodiment of the stripping device, and

FIG. 4 is a plan view of the stripping device of FIG. 3.

DESCRIPTION OF THE PREFERRED EMBODIMENT

Figure 1:
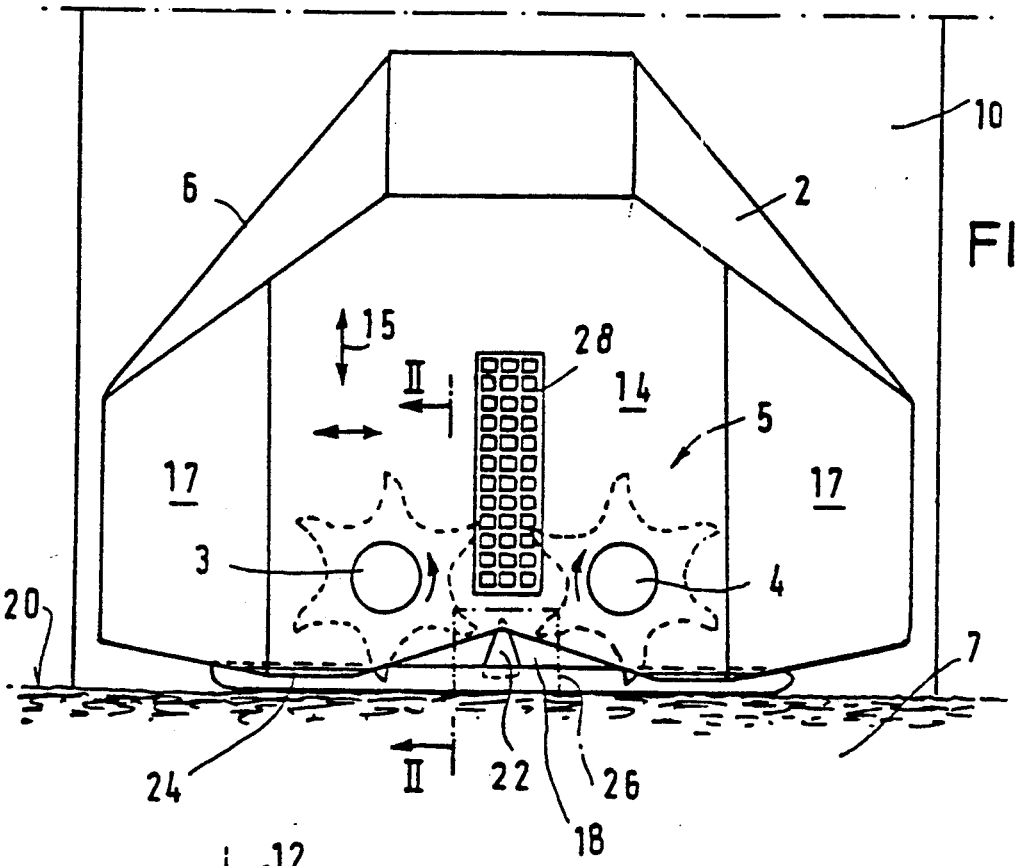
FIG. 1 is a front view of the milling device of a bale opening device.
Figure 2:
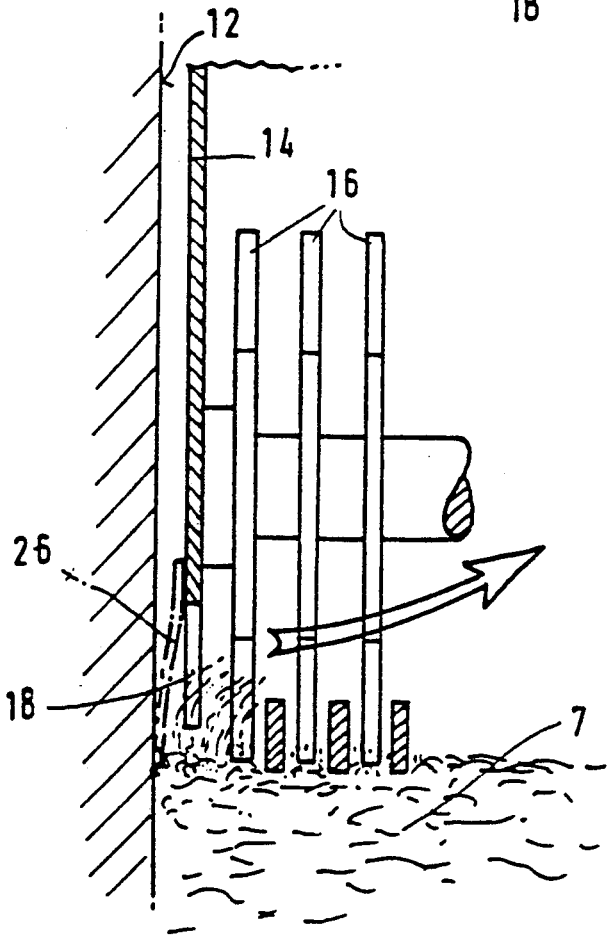
FIG. 2 is a cross section of the arm in the region of the suction opening in the front wall.

The arm 2 illustrated in FIG. 1 is a part of a ball opening device with a tower 10 on a carriage (not illustrated) that is adapted for a shuttle movement along the bale rows 7. To this end, a guide track (not illustrated) is provided on which the carriage is guided. The arm 2 projecting from the tower 10 has a milling device 5 for reducing the fiber bales. The milling device 5 may consist of two milling rollers 3,4 that are driven for rotation about their longitudinal axes. The arm 2 containing the milling device 5 may be moved up and down in the vertical direction, as indicated by arrow 15, by means of an adjustable advance. The milling rollers 3 and 4 rotate upward in opposite directions toward the center between the pairs of rollers, taking fibers or flocks off the bale surface 20 and throwing them upward between themselves. By means of a pneumatic suction flow, the loosened fibers are conveyed through a hopper into the tower 10 in which a telescope guide means leads to a lower longitudinally extending collecting channel. With the height of the row of pressed bales 7 decreasing, the arm 2 and the reduction device 5 are lowered correspondingly.

The front wall of the casing 6 of the arm is to come as close as possible to the bale supporting wall 12 so that, while wall milling the row of bales 7, the bales can be completely reduced up to the wall without the bales having to be set up at a distance from the bale supporting wall 12, e.g. by means of spacers. The front wall 14 extends perpendicularly to the axes of the milling rollers 3,4, the wall being folded towards the tower 10 at an acute angle relative to the bale supporting wall 12 immediately behind the working area of the toothed discs 16 of the milling rollers 3, 4. The folding of the front wall 14 allows reduction of the distance between the front wall and the bale supporting wall, since the free space needed for a collision-free rotation of the tower 10 and the arm 2 is reduced.

Figure 5:
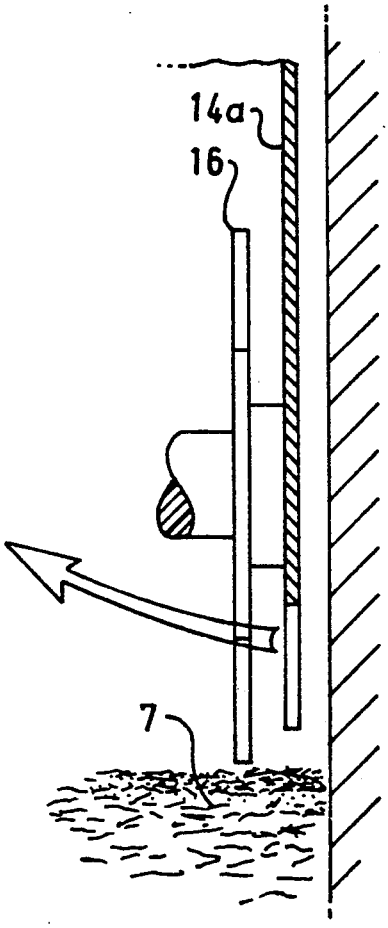
FIG. 5 is a cross section of an alternate embodiment of the arm in the region of the suction opening in the rear wall.

A suction opening 18 of a substantially triangular cross section is provided in the front wall 14 between the two milling rollers 3, 4, which opening—being open towards the bale surface—has a cross section increasing towards the center between the milling rollers, starting approximately from the deepest working area of the milling rollers 3,4. This suction opening 18 allows suction in of the fiber flocks not caught by the frontmost toothed disc 16 so that the bales 7 can be completely reduced up to the bale supporting wall 12. Before they reach the tower 10, the bale remainders sucked off at the bale supporting wall 12 pass several rows of toothed discs so that the teeth of the toothed discs also catch, disintegrate and throw these fibers upward into the suction chamber arranged above. The rear wall 14*a*, shown in FIG. 5, of the arm casing 6 arranged opposite the front wall 14 may have a suction opening corresponding in position and shape to the suction opening 18 in order to also suck off bale remainders the rear edge of the bale possibly projecting beyond the milling device 5, when the bales take the full length of the arm.

An air guiding wedge 22 of a substantially triangular cross section, arranged between the milling rollers and extending over the entire length of the milling device 5, serves to direct the air flow in the middle between the milling rollers 3,4 in an upward direction. Both at the front and the rear wall, the air guiding wedge 22 begins only at a distance from the suction opening 18, preferably at a distance of 100 mm.

The front lower end of the front wall 14 is provided with a rigid lip 24 on both sides of the suction opening 18, which projects obliquely to the bale supporting wall 12, which lip is to support the pressing of the outer bale edge towards the milling device 5 when the arm is lowered.

In the central area between the milling rollers 3, 4, a stripping device 26 may be arranged at the front wall 14 before the suction opening 18, which is resiliently pressed against the bale supporting wall 12 and scratches the wall when the milling device 5 is advanced, pressing bale remainders still near the wall towards the milling device 5, whereby they may be caught better by the suction device 18. The stripping device 26 may consist of a narrow strip, e.g. of Vullkolan, extending to the plane of bale reduction.

Referring now to FIGS. 3 and 4, in the embodiment of a stripping device of metal or a resilient plastics material lateral members 30 of the stripping device 26 are angled away from the front wall 14 towards the bale supporting wall 12 so that the stripping device 26 is directed away from the front wall 14 in both directions of movement of the arm casing 6. Moreover, the stripping device 26 is angled toward the bale supporting wall 12 in its lower portion, the front edges of the lateral members 30 being in a vertical plane with the front edges of the lower edge of the stripping device 26 angled towards the bale wall. The stripping device 26 causes a mechanical urging of the bale edges into the area of the milling rollers.

An air-intake opening 28 for secondary air may be provided in the front wall 14 above the suction opening 18, having an adjustable suction surface. In this way, the ratio of the air flow sucked in via the opening 28 can be adjusted relative to the air flows sucked in at the bale surface.

The features of the invention disclosed in the above specification, the Figures and the claims, even when described only in connection with a particular embodiment, are essential for the realization of the invention in its various embodiments both as individual features or as a combination thereof.

We claim:

1. A device for opening rows of pressed fiber bales, comprising:

an upstanding supporting wall along which the rows of pressed fiber bales may be aligned;

a housing associated with said supporting wall, said housing defining a front wall portion adjacent and facing said supporting wall;

milling means associated with said supporting wall and carried in said housing adjacent said front wall portion of said housing for removing fibers from the surfaces of rows of pressed fiber bales, said milling means including at lest two milling rollers for contacting the pressed fiber bales to loosen fibers therefrom;

suction means associated with said milling means for sucking loosened fibers from said milling means, said suction means defining a suction opening in said front wall potion of said housing between said two milling rollers for sucking loosened fibers from between said milling means and said upstanding supporting wall; and stripping means associated with said front wall portion adjacent said suction opening for abutting said supporting wall and for urging portions of the pressed fiber bales towards said milling means.

2. The device according to claim 1, wherein the cross section of said suction opening is enlargened towards the center between said two milling rollers.

3. The device according to claim 1, wherein said suction opening extends to

4. The device according to claim 1, wherein said housing includes a rear wall portion opposite to an facing said front wall portion; said housing defining a second suction opening between and below said two milling rollers, open towards the surfaces of the pressed fiber bales, said second suction opening being defined in said rear wall of said housing.

5. The device according to claim 1, wherein said stripping means angles away from said front wall of said housing towards said supporting wall.

6. The device according to claim 1, wherein the front wall defines an intake opening for secondary air, the suction surface of which is adjustable.

7. The device according to claim 1, wherein the front wall of the housing extends substantially perpendicularly to the axes of said two milling rollers in the area adjacent said two milling rollers, and that said front wall is provided with respective inwardly angled recessed front wall portions adjacent the sides of the milling area.

8. An opening device for opening rows of pressed fiber bales positioned against an upstanding surface, the opening device comprising:

a housing defining a front wall portion for being positionable adjacent and facing the upstanding surface;

milling means carried in said housing adjacent said front wall portion of said housing for removing fibers from the top surfaces of rows of pressed fiber bales, said milling means including at least two milling rollers for contacting the pressed fiber bales to loosen fibers therefrom;

suction means associated with said milling means for sucking loosened fibers from said milling means, said suction means defining a suction opening in said front wall portion of said housing between said two milling rollers for sucking loosened fibers from between said milling means and the upstanding surface; and stripping means associated with said front wall portion adjacent said suction opening for abutting said supporting wall and for urging portions of the pressed fiber bales towards said milling means.

* * * * *